US006509701B1

(12) United States Patent
Rakhimov et al.

(10) Patent No.: US 6,509,701 B1
(45) Date of Patent: Jan. 21, 2003

(54) METHOD AND DEVICE FOR GENERATING OPTICAL RADIATION

(76) Inventors: Alexandr Tursunovich Rakhimov, Rostovskaya Nab., 1-95, 119121 Moscow (RU); Jury Alexandrovich Mankelevich, Volzhskiy Bulvar, 12-1-103, 109125 Moscow (RU); Vladimir Vitalievich Ivanov, Ul. Garibaldi, 4-2-54, 117313 Moscow (RU); Tatiyana Viktorovna Rakhimova, Rostovskaya Nab, 1-95, 119121 Mosow (RU); Nikolai Vladislavovich Suetin, Pr. Lenina, 20A-36, 144005 Elektrostal (RU)

( * ) Notice: Subject to any disclaimer, the term of this patent is extended or adjusted under 35 U.S.C. 154(b) by 0 days.

(21) Appl. No.: 09/701,844

(22) PCT Filed: Jun. 4, 1999

(86) PCT No.: PCT/RU99/00189

§ 371 (c)(1),
(2), (4) Date: Feb. 5, 2001

(87) PCT Pub. No.: WO99/65060

PCT Pub. Date: Dec. 16, 1999

(30) Foreign Application Priority Data

Jun. 5, 1998 (RU) ..... 98110774
May 28, 1999 (RU) ..... 98110628

(51) Int. Cl.[7] ..... H05B 37/00

(52) U.S. Cl. ..... 315/363; 313/524; 313/525; 313/542; 313/543; 250/395

(58) Field of Search ..... 315/363, 169.1; 313/524, 525, 527, 530, 542, 543, 544, 495, 496, 491; 369/284; 250/382, 393, 395

(56) References Cited

U.S. PATENT DOCUMENTS 4,069,438 A * 1/1978 Houston et al. ..... 250/501
4,217,578 A 8/1980 Inami et al. ..... 340/754

(List continued on next page.)

FOREIGN PATENT DOCUMENTS

RU 50774 3/1937

OTHER PUBLICATIONS

Parol, N.V. et al., Znakosinteziryjuschie indikatory i ikh primenenie. Moscow, Radio i svyaz, pp. 9–13. (To follow).
Rokhlin, G.N., Discharge Light Sources, Energoatomizdat, 1991, p.392. (Enclosed).
Dobretsov, L.N. et al., Emittion electronics, Moscow, Nauka, 1966, p. 245 (Enclosed).

(List continued on next page.)

*Primary Examiner*—Don Wong
*Assistant Examiner*—Thuy Vinh Tran
(74) *Attorney, Agent, or Firm*—Collard & Roe, P.C.

(57) ABSTRACT

The present invention may be used in the field of microelectronics, in medicine as well as in the production of lighting appliances. The method and the device of the present invention are used for increasing the brightness of optical radiation sources powered by low-voltage power supplies. The optical radiation is generated by emitting electrons and by exciting the radiation. The electrons are generated by emitting the same from the surface of a cathode, while the excitation of the radiation involves accelerating the electrons in the gaseous interval up to an energy exceeding the excitation energy of the radiating levels of the gas. To this end, a voltage is applied between the cathode and the anode, wherein said voltage does not exceed the ignition voltage of a self-maintained discharge. The device of the present invention comprises a chamber as well as electrodes having surfaces which are transparent to the radiation. The gas pressure inside the chamber is determined from balance conditions between the energetic length of an electron trip and the distance between said electrodes.

10 Claims, 1 Drawing Sheet

U.S. PATENT DOCUMENTS

| | | | | | |
|---|---|---|---|---|---|
| 4,962,334 | A | | 10/1990 | Godyak | 313/619 |
| 5,311,010 | A | * | 5/1994 | Kruger | 313/538 |
| 5,686,789 | A | * | 11/1997 | Schoenbach et al. | 313/491 |
| 6,275,270 | B1 | * | 8/2001 | Culkin | 313/524 |

OTHER PUBLICATIONS

Display, ed. by J. Pankov, Moscow, Mir, 1982, pp. 123–126. (enclosed).

* cited by examiner

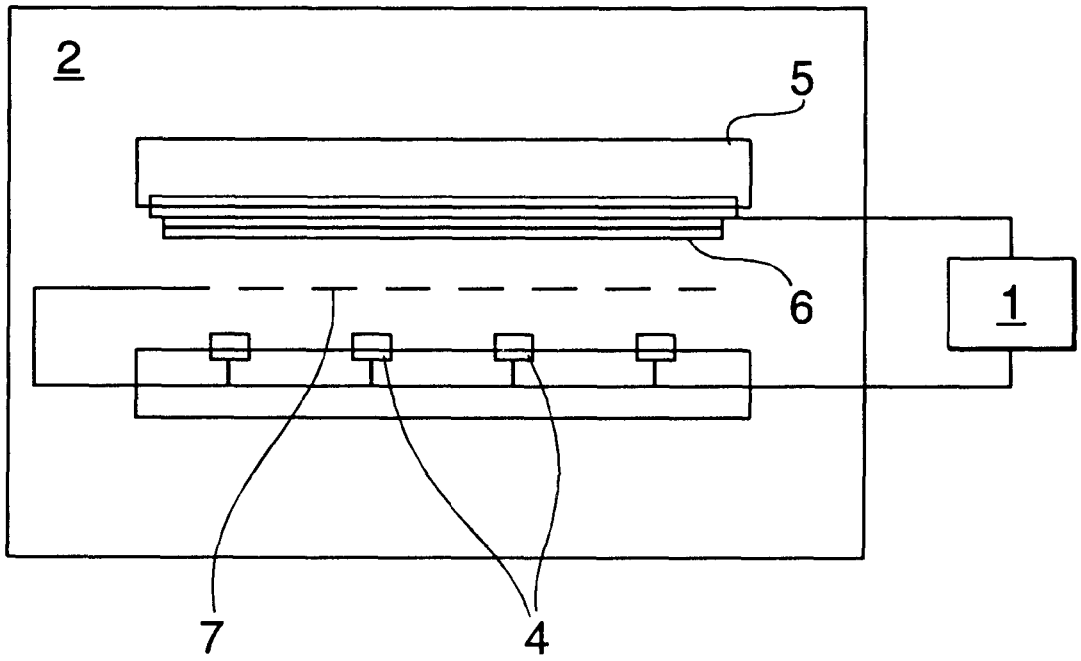
2
5
6
1
7
4

METHOD AND DEVICE FOR GENERATING OPTICAL RADIATION

CROSS REFERENCE TO RELATED APPLICATIONS

Applicants claim priority under 35 U.S.C. §119 of Russian Application Nos. 98110774 and 98110628, filed Jun. 5, 1998 and May 28, 1999, respectively. Applicants also claim priority under 35 U.S.C. §120 of PCT/RU99/00189, filed Jun. 4, 1999. The international application under PCT article 21(2) was not published in English.

FIELD OF USE

Light sources are broadly used in the industry. In particular, vacuum ultraviolet radiation is used to etch resists in microelectronics, to desinfect spent materials, tools and equipment in medicine. Visible light sources of various spectrum are the illumination devices and information displays of different kind. Some of the most frequently used methods and related devices to generate optical radiation are the gas discharge light sources. For example, luminescent lamps are broadly used which are generating visible light. These lamps are based on the gas discharge in a noble gas at low pressure which is admixed with mercury which radiation is converted by a phosphor into visible light. Same principle is also used to produce plasma displays where the same type of discharge, though without mercury and at a higher gas pressure, is employed. Such broad use makes it important to build an effective compact visible light source.

PRIOR ART

Methods to generate optical radiation which are used in e.g. fluorescent gas discharge lamps of low pressure are known [Rokhlin G. N. Discharge light sources, Energoatomizdat, 1991, p.392]. These methods though being effective still possess a number of shortcomings which can not be excluded, for example, environments pollution with mercury possible if the lamp is broken.

Method to generate optical radiation and devices based thereupon are known where electrons emitted from a cathode are accelerated in the vacuum gap due to voltage applied to it and then generate optical radiation of cathode rays phosphor [Dobretsov L. N., Gamaiunova M. V. (<<Emittion electronics>>, Moscow, Nauka, 1966, p.245]. Main shortcoming of light sources based on this methods is a low effectiveness of cathode rays luminescence, especially at low voltage.

Method is also known comprising generation of electrons and generation of radiation from a gas discharge gap and a device to do the same which further comprise a chamber filled with the light emitting gas, and at least two electrodes, cathode and anode, placed in front of each other and at least one of which is made to be transparent for radiation [Dispalys ed. by J. Pankov, Moscow, Mir, 1982, pp.123–126]. Optical radiation is generated as a result of gas excitation in the discharge. Shortcoming of this method and device implementing it is a low effectiveness of conversion of electrical power into optical radiation.

SUMMARY OF THE INVENTION

Effectiveness of conversion of electrical power into optical radiation at lower voltage is the main purpose of the present invention.

The suggested method to produce an optical radiation comprises forming of an electron beam due to emission of them from a cathode surface and generation of radiation due to acceleration of electrons in the gas gap by an electric field applied between the cathode and anode up to the energy higher than excitation threshold of emitting energy levels of gas, but which is lower than self sustained discharge breakdown voltage, i.e. applied voltage is lower than a value when the gas ionization becomes an important factor leading to certain restrictions connected with presence of ions in the gas gap: surplus power losses inherent to the formed then electrode layers and shorter life of the light source because of bombardment of cathode with high-energy ions. Technically, ionization can be avoided, for example, due to a selection of voltage less than ionization potential of the gas, i.e. the electrons generation and acceleration in the gas gap is provided by a voltage which is less than I/e, where I is ionization potential of atoms or molecules of gas, e is an electron charge.

The device to generate an optical radiation comprises a chamber filled with a light emitting gas, for example, any noble gas, and at least two electrodes, cathode and anode, placed in front of each other and at least one of which is made to be transparent for radiation. Gas pressure is determined by a selection of a gap between the electrodes which should be about the electron energy relaxation length.

Radiation produced due to excitation of gas particles can escape through the transparent electrodes or converted into radiation of another spectral range via excitation of emitting states of phosphor. Phosphor can be placed both on the interior and external electrode surfaces including transparent parts of the electrodes, and it can be deposited in the form of RGB triads covering every particular point. Cathode can be made as a photocathode, thermocathode or autoemission cathode. Autoemission cathode can be made as a cold emission film cathode comprising a substrate coated with a diamond-carbon or carbon film emitter of electrons. For the purpose of additional control of the current at least one grid can be placed between the anode and cathode.

Autoemitting film cathode can be made in the form of parallel strips which width d is determined from a condition Ed=U where E is a strength of electrical field near the cathode strips surface which is sufficient to enable the needed autoemission, and spacing between the strips equals or exceed the width of interelectrode gap L determined from a condition of its equality to electron energy relaxation length what is selected by varying the gas pressure and voltage applied to the electrodes U which shall be lower than I/e where I is ionization potential of atoms or molecules of gas, e is an electron charge.

BRIEF DESCRIPTION OF DRAWING

The present invention can be better understood from the accompanying drawing where a schematic view is shown of a device to generate optical visible radiation containing an autoemissive film cathode and comprising a power supply (1), gas filled chamber (2), surfaces (3) on which a stripped cathode (4), anode (5) and phosphor (6) are placed. The cathode strips (4) shall be made from a material which enables maximal high effectiveness of electron emission.

DESCRIPTION OF THE PREFERRED EMBODIMENTS

Due to a proper selection of operational parameters of the cathode the electron current can be maintained at a given magnitude. The electrons drift in the electrical field applied between the cathode (4) and anode (5) and cause excitation and ultraviolet radiation of gas filling the chamber (2), and a subsequent excitation of phosphor (6).

DC or pulsed electrical field is supplied by a power supply unit (1). Operational voltage range can vary from a few to dozens volts. Minimal voltage is determined by the excitation energy threshold of a lower emitting state, what is in xenon equals to 8.5 eV, and maximal voltage determined by a condition for igniting of a self-sustained discharge.

Brightness of the light source increases as voltage between the electrodes is incremented, and if the voltage is fixed then it increases as the electrical field in the gap is incremented. In case of pulsed voltage, brightness additionally can be controlled by a pulse repetition rate and variation of the pulse duration. The required electron emission rate from the cathode can be provided by various means. In case of autoemissive cathode the electrical field strength shall be high enough to cause a pronounced autoemission current (E~2–10 V/micron for a cold emission film cathode).

In case of thermocathode the gas pressure and discharge voltage are restricted only with a condition of absence of pronounced ionization of the gas, and also the necessity to provide the acceptable power loss level to heat the cathode and avoid overheating the phosphor. To minimize these losses one must use a low temperature thermoemissive cahode placed inside the chamber and a gas with poor thermal conductivity, for example, xenon.

In case of photocathode a restriction is imposed on a magnitude of maximal discharge voltage U. It shall be selected as to ensure the sufficient photoemission of electrons from a cathode while providing the absence of ionization in the interelectrode gap: $U>\beta\epsilon/\eta\gamma_{ph}$, where $\gamma_{ph}$ is a photoemission coefficient from the cathode, $\gamma_{ph}\approx 0.1$ for best photocathodes, $\epsilon$ is a mean energy in electron volts required to generate one photon, $\eta$ is the efficiency of conversion of power fed to the device into energy of optical radiation, $\beta$ is a geometry factor. For example, in xenon and at optimal magnitude of the reduced electrical field and $\beta=2$ one can obtain $\eta\approx 0.9$ $\epsilon\approx 9$ eV and U>130V. For control of additional current, at least one additional grid can be placed between the anode (5) and the cathode (6).

APPLICABILITY IN INDUSTRY

Devices generating optical radiation implementing the suggested method can be used for a broad range of applications from medicine to high tech where the light sources in different spectral range are required providing their brightness control. The suggested device could be applied in projectors, backlight lamps for liquid crystal displays, elements of outdoor screens where the high brightness is needed, compact and self maintained light source devices where the use of lower voltage is preferred. The device also can be used in any other applications where it is important to have a big aperture light source.

What is claimed is:

1. Method to generate an optical radiation comprising a generation of electrons and subsequent excitation of radiation from a gas wherein said generation of electrons is provided due to emission of the electrons from a cathode surface and excitation of radiation is provided via acceleration of electrons in gas gap by a voltage applied between the cathode and anode up to the energy higher than energy of emitting states of the gas, but lower than breakdown voltage of a self-sustained discharge, wherein said generation of electrons and subsequent acceleration of the electrons in the gas gap are provided by a voltage whose magnitude is less than I/e, where I is ionization potential of atoms or molecules of gas, e—is an electron charge.

2. Device to generate an optical radiation comprising a chamber filled with a light emitting gas and at least two electrodes, cathode and anode, placed in front of each other, and at least one of the electrode surfaces where the electrodes are placed, including the surface of said electrodes, is transparent for radiation, further comprising that the light emitting gas pressure is determined by a condition to select the gap between the electrodes to be about the electron energy relaxation length.

3. Device set forth in claim 2 wherein the cathode is made as a photocathode.

4. Device set forth in claim 2 wherein the cathode is made as a thermocathode.

5. Device set forth in claim 2, wherein the cathode is made as an automission cathode.

6. Device set forth in claim 5 wherein the autoemission cathode is made in a form of a cold emission film cathode comprising a substrate coated with a diamond-carbon or carbon film emitter of electrons.

7. Device set forth in claim 6, wherein said cathode is made in a form of parallel conductive strips whose width d is determined from a condition Ed=U where E is a strength of electrical field near the cathode strips surface which is sufficient to enable the autoemission, and spacing between the strips equals or exceeds the width of interelectrode gap L determined from a condition of its equality to electron energy relaxation length that is selected by varying the gas pressure and voltage applied to the electrodes U which shall be lower than I/e where I is ionization potential of atoms or molecules of gas, e is an electron charge.

8. Device set forth in claim 2 wherein at least said electrode surface which is transparent for radiation of gas and whereon the electrodes are placed, including the surface of said electrodes is coated at its external side with a layer of phosphor, or said electrode surface which is transparent for visible radiation of phospor and whereon the electrodes are placed, including, for example, the surface of said electrodes, is coated at its internal side with a layer of phosphor.

9. device set forth in claim 8, wherein the phosphor is deposited in a form of RGB triads covering every separate point.

10. Device set forth in claim 2, further comprising at least one additional grid electrode between the cathode and anode.

* * * * *